US008468733B2

(12) United States Patent
Deros

(10) Patent No.: US 8,468,733 B2
(45) Date of Patent: Jun. 25, 2013

(54) ACCESSORY RAILS WITH SLOT ADAPTERS AND MECHANISMS OF USE

(76) Inventor: Mark A. Deros, Lubbock, TX (US)

( * ) Notice: Subject to any disclaimer, the term of this patent is extended or adjusted under 35 U.S.C. 154(b) by 0 days.

(21) Appl. No.: 13/195,844

(22) Filed: Aug. 2, 2011

(65) Prior Publication Data

US 2013/0031820 A1 Feb. 7, 2013

(51) Int. Cl.
*F41C 27/00* (2006.01)

(52) U.S. Cl.
USPC ..... 42/90

(58) Field of Classification Search
USPC ..... 42/90, 85, 106, 124, 94, 71.01, 127, 42/72; 89/37.04, 40.06; 396/425, 428; 248/187.1, 689, 220.21, 222.11, 222.12, 248/223.41
See application file for complete search history.

(56) References Cited

U.S. PATENT DOCUMENTS 3,327,422 A 6/1967 Harris
4,470,216 A 9/1984 Harris
4,625,620 A 12/1986 Harris
4,637,580 A * 1/1987 Idstein ..... 248/95
4,641,451 A 2/1987 Harris
4,903,425 A 2/1990 Harris
5,074,188 A 12/1991 Harris
5,305,540 A * 4/1994 Blenk ..... 42/85
5,692,654 A 12/1997 Bell
7,431,247 B2 10/2008 Bobro
7,845,267 B2 12/2010 Potterfield
7,856,748 B1 12/2010 Mertz
2005/0217161 A1* 10/2005 Haugen et al. ..... 42/124
2007/0163163 A1* 7/2007 Munst ..... 42/85
2007/0164177 A1* 7/2007 Peterson et al. ..... 248/187.1
2008/0134560 A1* 6/2008 Pierce et al. ..... 42/94
2008/0244951 A1* 10/2008 Picard et al. ..... 42/71.01
2010/0170133 A1* 7/2010 Swan ..... 42/85

* cited by examiner

*Primary Examiner* — Michael Carone
*Assistant Examiner* — Reginald Tillman, Jr.
(74) *Attorney, Agent, or Firm* — Sarah Hegi Simpson; McWhorter, Cobb & Johnson, LLP

(57) ABSTRACT

Accessory rails with slot adapters and mechanisms of use are disclosed. The accessory rail is mountable on a primary device, such as a firearm, for releasably attaching an auxiliary device directly to the accessory rail. The accessory rail generally includes a rail body and at least one slot adapter, which is integrally formed within the rail body, for receiving attachment means of the auxiliary device.

19 Claims, 6 Drawing Sheets

ACCESSORY RAILS WITH SLOT ADAPTERS AND MECHANISMS OF USE

FIELD OF DISCLOSURE

The present disclosure relates generally to devices and mechanisms for attaching auxiliary devices to primary devices such as firearms. More specifically, the present disclosure relates to devices and mechanisms for releasably attaching auxiliary devices (e.g., Harris Bipods) to firearms.

BACKGROUND

Universal firearm accessory rails such as the widely used "Picatinny rail" (i.e., MIL-STD-1913 rail) provide a standardized platform for attaching auxiliary devices or accessories (e.g., telescopic sights, magnifiers, tactical lights, night vision devices, bipods, tripods, etc.) to firearms. Today, such accessory rails are commonly mounted on firearms as they allow users to easily modify firearm configurations by quickly attaching and detaching accessories to and from the mounting projections of the rails.

Generally, accessories are coupled to accessory rails by utilizing mount adapter devices, which are configured to releasably attach to the rails. Once an accessory is coupled to a mount adapter device, the releasable locking mechanism of the adapter device allows a user to modify firearm configurations by selectively attaching, detaching, and reattaching the adapter device, which is coupled to the accessory, to the firearm as needed.

Although mount adapter devices provide the advantage of quick field modification of firearm configurations, said adapter devices also present several disadvantages. For example, these adapter devices increase the size and bulk of the overall firearm configuration which makes attached accessories more susceptible to being inadvertently forced out of position on the rail by an external force or upon an accidental impact.

Moreover, many mount adapter devices employ locking levers to lock the adapter device to the rail, and it is well known in the art that such locking levers are prone to breakage. Upon breakage, in military engagement settings for example, users would not have time to replace the broken adapter device and would be forced to abandon their mission or to complete the mission without the aid of a needed accessory.

Another problem with employing mount adapter devices is that the attachment mechanism requires two steps, namely, attaching the accessory to the adapter device and then attaching the adapter device to the rail. Additionally, many adapter devices are not designed to account for the different dimensions that are seen among different accessory rails; this results in the adapter devices damaging the rails, as well as the failure of the adapter devices to provide secure attachment to all rails.

Another notable disadvantage is that certain accessories, including certain bipods, are not generally designed to be coupled to mount adapter devices. Bipod accessories are widely used for supporting and stabilizing firearms. Due to factors such as vibration, recoil, user fatigue, or accidental contact with external objects, users are unable to support and stabilize a firearm in a non-moving position for any considerable amount of time. Thus, users often employ bipods to support and stabilize firearms on the ground, a low wall, a bench rest, or other object, thereby reducing user fatigue and permitting increased shooting accuracy.

Even though bipods offer many advantages to firearm users, bipods also present the disadvantage of reducing the portability of firearms by increasing the weight and the size of the complete firearm configuration. This is because many bipods are not designed for quick and easy attachment to and detachment from a firearm. Rather than employing mount adapter devices for attachment to firearms, many bipods are configured to attach to firearms by utilizing a sling stud or a similar bipod adapter stud, which may be included with or added to a forearm or forward end of the firearm. For example, the so-called "Harris Bipods," which are widely used and well-known in the art, such as the bipod disclosed by Harris in U.S. Pat. No. 4,625,620, include an upper attachment configuration which is configured to attach to a sling stud on a firearm. As further explained below, conventional devices and mechanisms utilized for bipod attachment present several disadvantages.

A major problem with conventional bipod attachment is the inability to mount bipods, particularly Harris Bipods, to firearms without requiring the use of special tools and/or the machining or modification of the firearm by specialty gunsmiths to accommodate a bipod adapter stud. Not only is such modification expensive, but it can also mar the finish of the firearm. In addition to being difficult to install, many bipod adapter studs and sling studs are nearly impossible to remove without causing severe damage to the firearm stock. Further, the use of studs can create a dangerous situation as the studs have a tendency to become loose or to completely disconnect from the firearm. This can result in the bipod inadvertently detaching from the firearm, thereby causing the firearm to unexpectedly fall and possibly misfire. Another disadvantage is that protruding studs, extending beyond the surface of the firearm stock, often scratch and disfigure shooting rests, furniture, and other surfaces. Furthermore, attaching a bipod to a stud is difficult and frustrating since the two attachment pins of the bipod's upper attachment configuration must be perfectly aligned with and inserted into a small aperture in the stud in order to properly attach to the stud. This is an especially difficult, if not impossible, task to complete in dark settings.

In accordance with the foregoing, there is an increased need for a device and a mechanism that provides for direct accessory attachment to accessory rails, thereby eliminating the need for a separate mount adapter device or installation of a bipod adapter stud. Opposed to prior devices and mechanisms that require tools or two hands to attach a bipod to a firearm, a device is needed that provides a quick and effortless attachment mechanism for releasably attaching accessories, particularly bipods, to firearms without the necessity of tools and requiring only one hand. Additionally, a device is needed that provides a more compact and lightweight overall firearm configuration. Further, a device is needed that provides consistent and secure attachment of accessories to firearms and that is not susceptible to breakage, thereby allowing attached accessories to withstand the impact of external forces.

In view of the foregoing, it is apparent that there exists a need in the art for a device and a mechanism for attaching accessories to firearms which overcomes, mitigates, or solves the above problems in the art. It is a purpose of the disclosed device and mechanism to fulfill this and other needs in the art which will become more apparent to the skilled artisan once given the following disclosure.

ADVANTAGES AND SUMMARY OF THE INVENTION

It is an object of the present invention to overcome the above described drawbacks associated with prior devices and mechanisms for attaching accessories (e.g., Harris Bipods) to firearms. To achieve these and other advantages and in accordance with the purpose of the disclosed invention, as embodied and broadly described, the present disclosure provides for a device and a mechanism for releasably attaching accessories, such as Harris Bipods, to firearms.

The device disclosed herein generally includes an accessory rail that can be mounted on a primary device (e.g., a firearm or camera). Said accessory rail includes an integral slot adapter for accessory attachment. Said slot adapter is particularly designed for releasable attachment to a Harris Bipod. Harris Bipods include an upper attachment configuration having a pair of attachment links that can be easily and quickly attached to or detached from the slot adapter of the present device.

The accessory rail with slot adapter and mechanisms of use disclosed herein provide numerous advantages over prior devices and mechanisms for attaching accessories, particularly Harris Bipods, to firearms, including a quick and effortless attachment mechanism for releasably attaching accessories to firearms. The disclosed device provides a unique accessory attachment system that eliminates the need for a separate mount adapter device or installation of an adapter stud for attaching a bipod or other accessory (e.g., a shoulder sling) to a firearm. The attachment mechanisms provided by the present device allow a user to attach or detach a bipod, shoulder sling, or other accessory to or from a firearm with only one hand and without using tools. Additionally, the slot adapter is designed so that the pair of attachment pins on the attachment links found on a Harris bipod's upper attachment configuration, automatically align with one another for insertion into an aperture extending transversely through a central engagement wall of the slot adapter. Therefore, rather than expending time and effort to precisely align and insert the attachment pins into the small aperture of a sling stud or bipod adapter stud, the present device allows users to easily and quickly attach accessories (e.g., Harris Bipods) in any setting including dark settings and combat settings.

Another advantage provided by the current device is that it provides for a more compact and lightweight firearm configuration compared to prior devices, as the slot adapter is formed integrally within the accessory rail body. Compactness is accomplished by eliminating additional mount adapter devices and/or protruding sling studs, thereby resulting in the elimination of undesirable bulk and additional weight. At the same time, the integral slot adapter design provides for a device that is not susceptible to breakage and that offers improved attachment security over sling studs and bipod adapter studs, which tend to come loose over time. These features enable an accessory attached to the present device to withstand the impact of external forces.

These, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE DRAWINGS

The accompanying drawings, which are incorporated in and form a part of the specification, illustrate preferred embodiments of the device disclosed herein, and together with the description, serve to explain the principles of the invention. It is to be expressly understood that the drawings are for the purpose of illustration and description only and are not intended as a definition of the limits of the invention. In the drawings.

DETAILED DESCRIPTION

Figure 1:
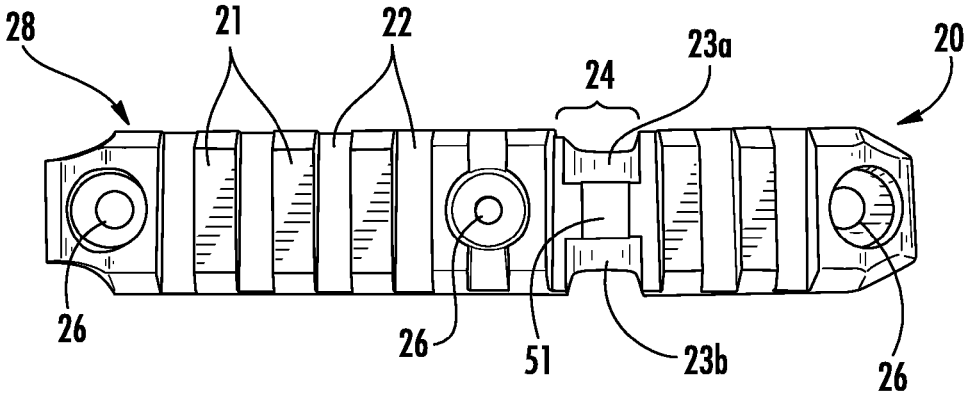
FIG. 1 is a top view of an accessory rail with a slot adapter constructed in accordance with the teachings of the present disclosure.

Referring now to FIGS. 1-6, exemplary embodiments of accessory rails with slot adapters in accordance with the present disclosure are illustrated and principally comprise a rail body 20 and at least one slot adapter 24 formed integrally within said body 20 to effect releasable attachment of auxiliary devices, particularly Harris Bipods 41, directly to the rail body 20, which is mountable on primary devices such as firearms 40.

The body of the accessory rail 20 includes a mounting surface 28 comprised of a plurality of mounting projections 21 extending perpendicularly along the longitudinal axis of the rail body 20, wherein said mounting projections 21 are separated by a plurality of transverse grooves 22 evenly spaced along the longitudinal axis of the rail body 20. The accessory rail body 20 can be of any suitable shape and size, but preferably is a Picatinny rail, conforming to MIL-STD-1913.

Figure 10:
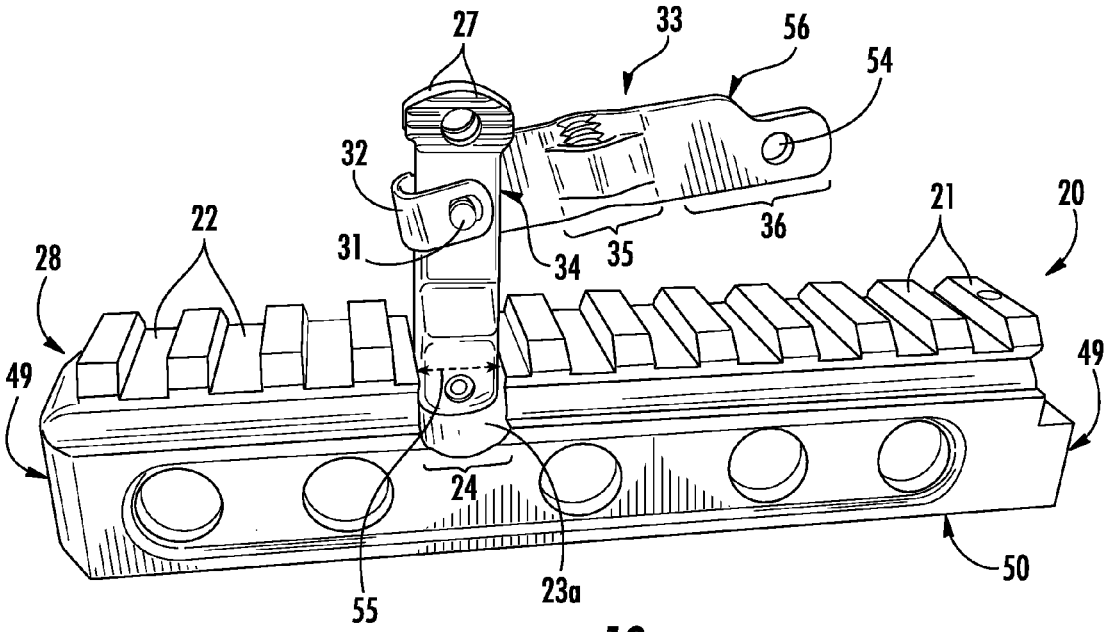
FIG. 10 is a side perspective view of the device shown in FIG. 4, illustrating a pair of attachment links coupled to the slot adapter of said device.

The mounting surface 28 further includes at least one slot adapter 24 formed integrally within said rail body 20. The slot adapter 24 includes a pair of oppositely-facing alignment slots 23*a*, 23*b* that are separated from each other by a central engagement wall 51. The engagement wall 51 further includes a throughbore or aperture 25 extending transversely therethrough. Said engagement wall aperture 25 is sized to receive attachment pins 29*a*, 29*b* of attachment links 27, as further explained below. As shown in FIG. 10, each alignment slot 23*a*, 23*b* is preferably designed to be just slightly wider than the width 55 of the head portion 46*a*, 46*b* of each attachment link 27. Additionally, the alignment slots 23*a*, 23*b* are aligned with one another. This arrangement aligns the head portions 46*a*, 46*b* with one another when the head portions are positioned in the alignment slots. Since the attachment pins 29*a*, 29*b* are press fit on the head portions 46*a*, 46*b*, this arrangement also aligns the attachment pins with one another for automatic insertion into the engagement wall aperture 25 when the head portions are placed in the alignment slots.

The body of the accessory rail 20 may further include a bottom surface 50 opposite the mounting surface 28, and side or lateral surfaces 49 that connect said mounting surface 28 to said bottom surface 50. As illustrated in FIGS. 1-6, said lateral surfaces 49 may include one or more cutouts or depressions 45 to decrease the weight of the device.

Figure 2:
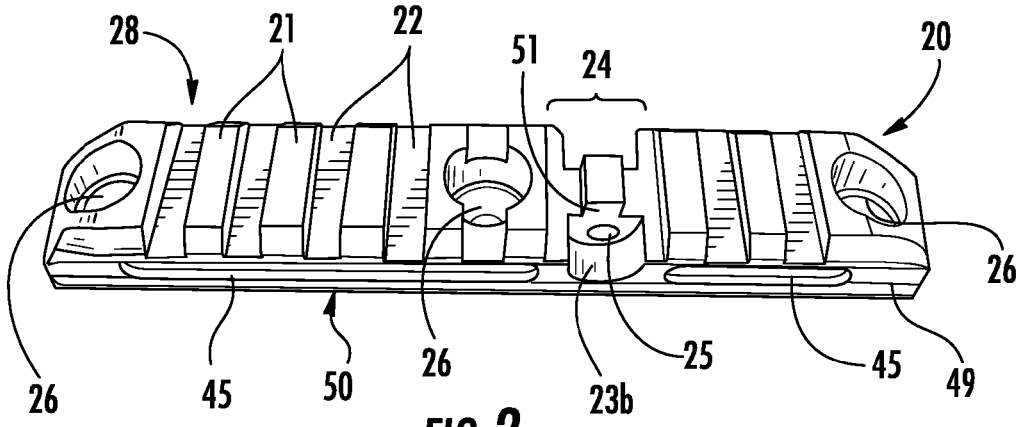
FIG. 2 is a top perspective view of the device shown in FIG. 1.
Figure 3:
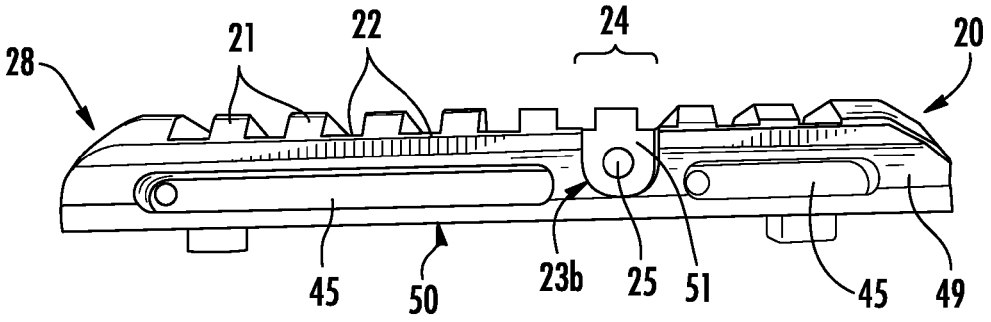
FIG. 3 is a side perspective view of the device shown in FIG. 1.
Figure 4:
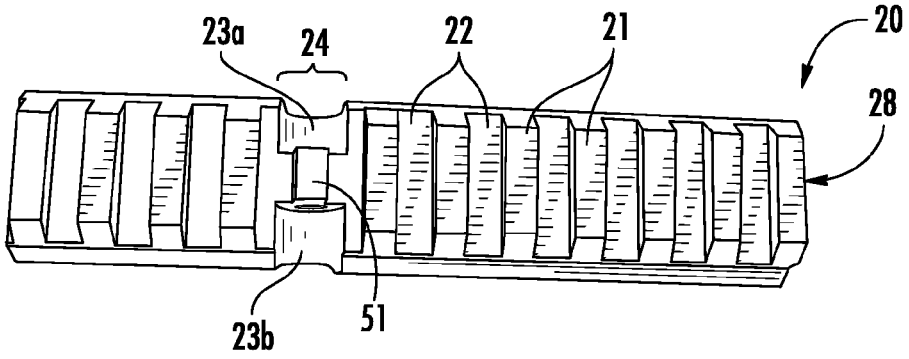
FIG. 4 is a top view of a second embodiment of an accessory rail with a slot adapter constructed in accordance with the teachings of the present disclosure.
Figure 5:
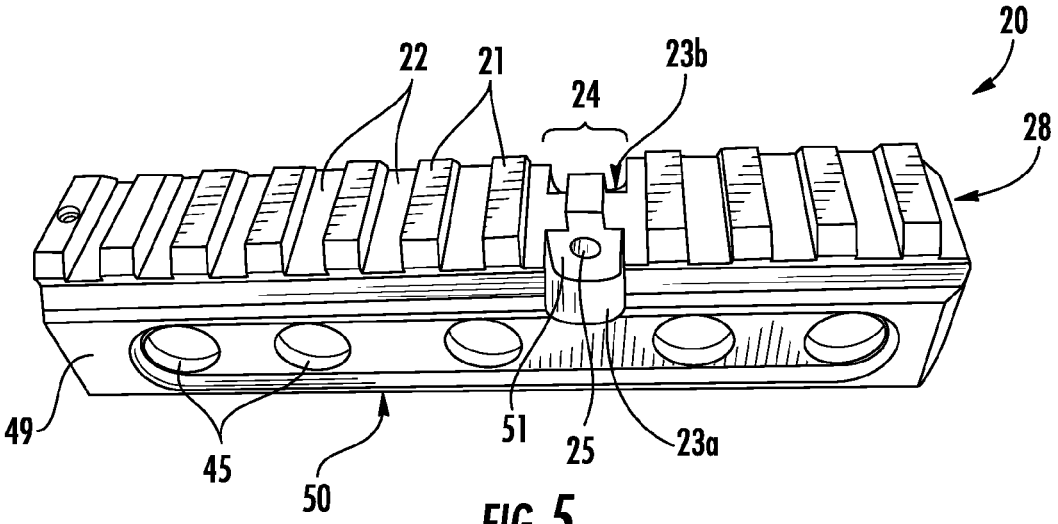
FIG. 5 is a top perspective view of the device shown in FIG. 4.
Figure 6:
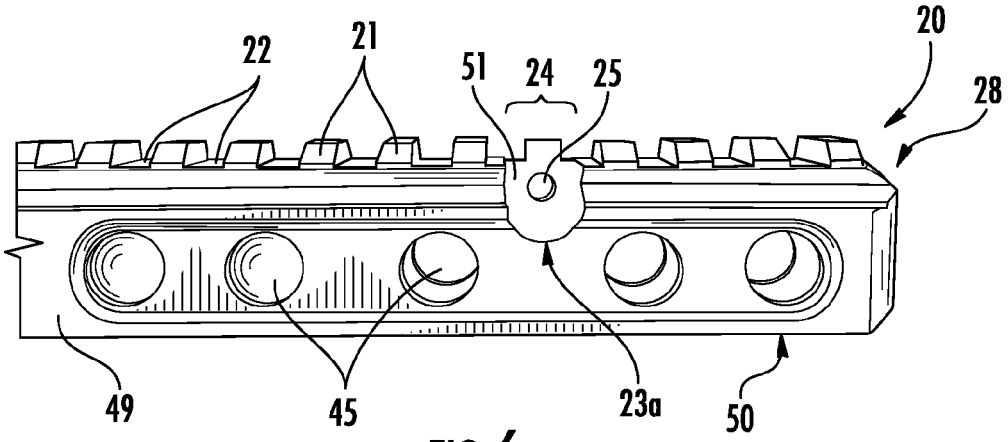
FIG. 6 is a side perspective view of the device shown in FIG. 4.
Figure 7:
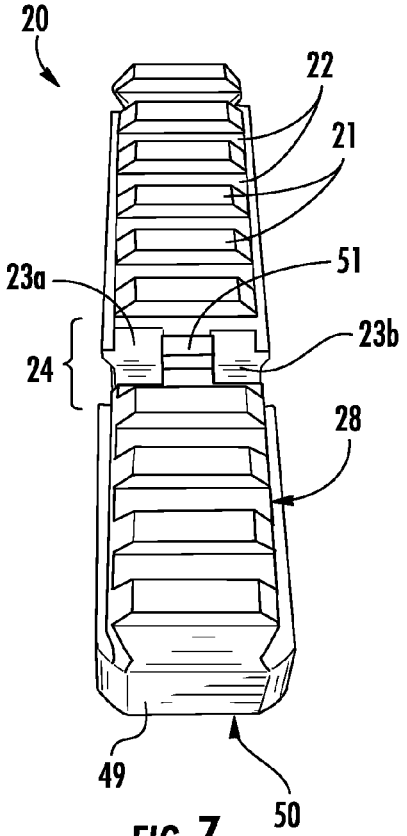
FIG. 7 is a front perspective view of the device shown in FIG. 4.

In the embodiment depicted in FIGS. 1-3, the body of the accessory rail 20 further includes apertures 26 allowing passage of a fastener (not depicted) through the apertures 26 for mounting the accessory rail body 20 to a primary device, such as a firearm 40 or camera. Other means for mounting an accessory rail body 20 to a primary device that are known in the art may also be used and are considered to be within the spirit and scope of the present invention.

Figure 12:
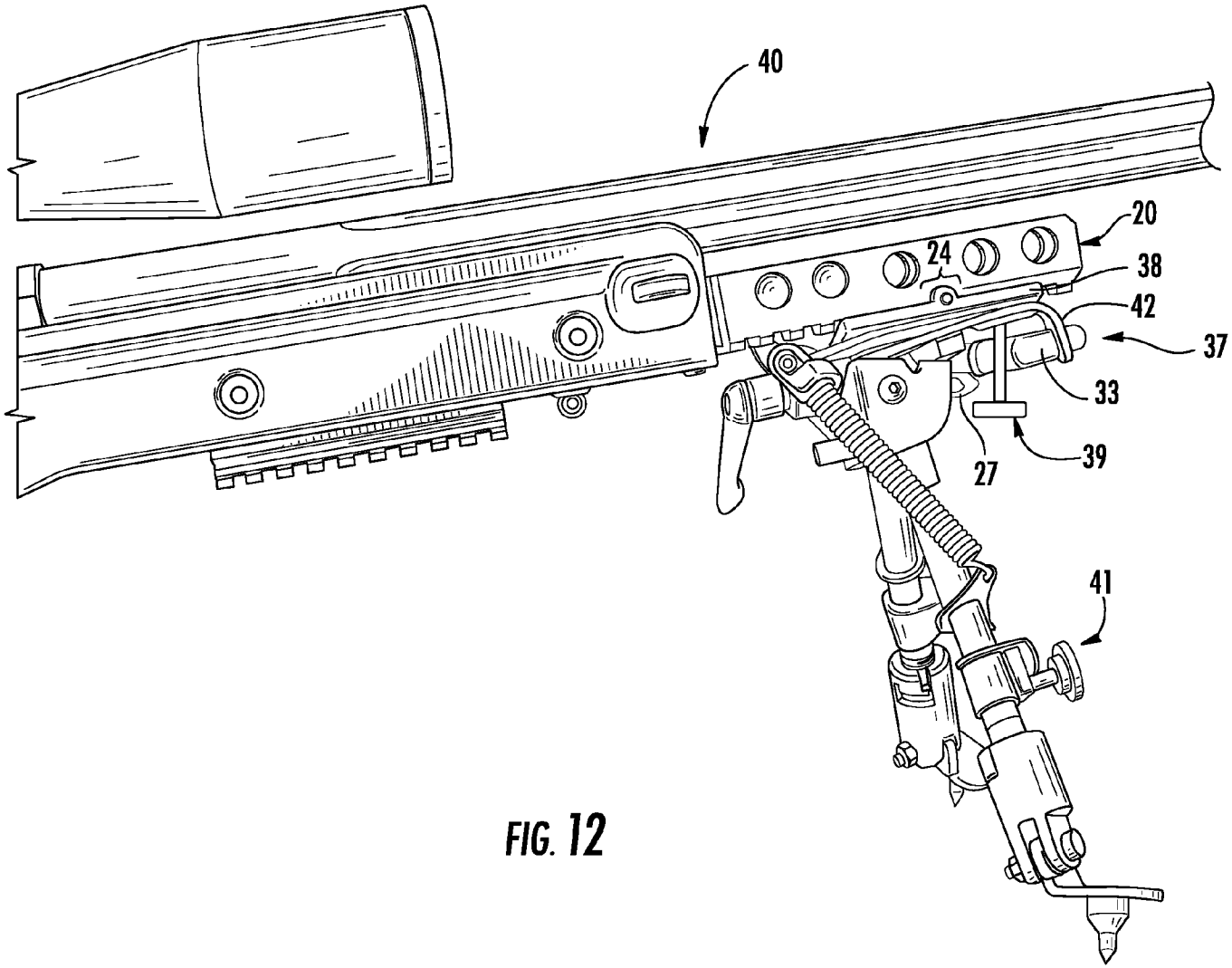
FIG. 12 is a side perspective view of the device shown in FIG. 4, illustrating the device mounted on a firearm with a Harris Bipod coupled to said device.
Figure 13:
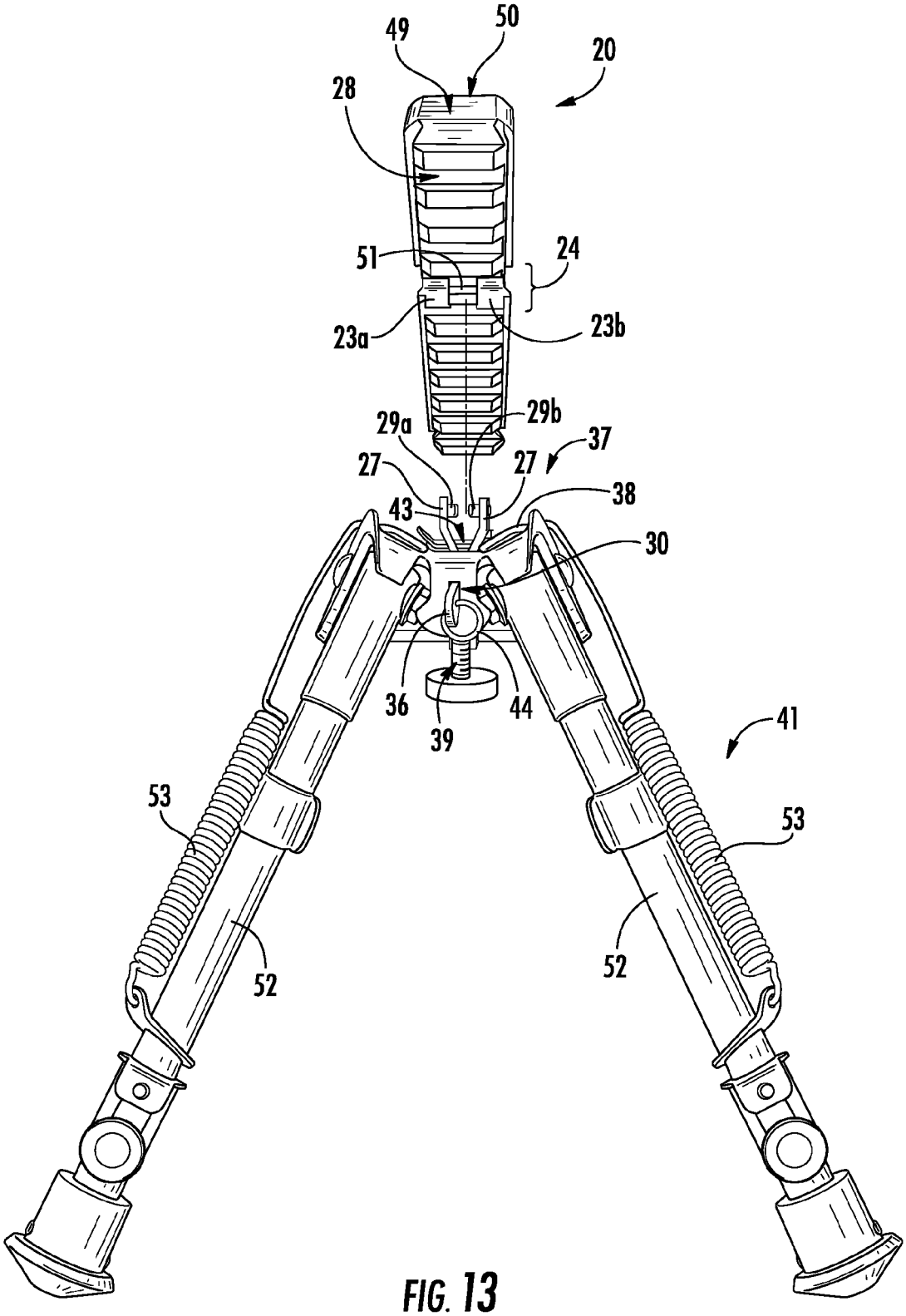
FIG. 13 is a front perspective view of the device shown in FIG. 4, illustrating said device positioned above a Harris Bipod.

As depicted in FIGS. 12 and 13, the prior art bipods 41 which are particularly intended for use with the present device generally comprise telescoping legs 52, strut assemblies 53, and an upper attachment configuration 37 for attaching the bipod 41 to a firearm 40. The upper attachment configuration 37 was originally designed for attachment to a conventional sling stud after removing the sling swivel therefrom. As described herein, however, the upper attachment configuration 37 can be attached to the present device to provide many advantages over prior devices and prior mechanisms of attachment.

Figure 8:
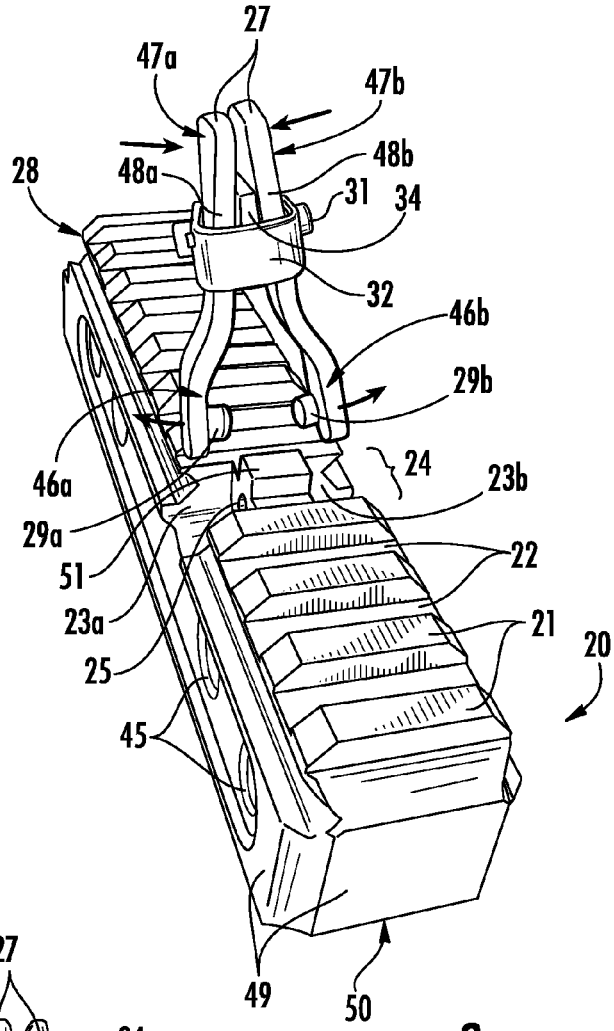
FIG. 8 is a front perspective view of the device shown in FIG. 4, illustrating a pair of attachment links positioned above the slot adapter of said device.
Figure 11:
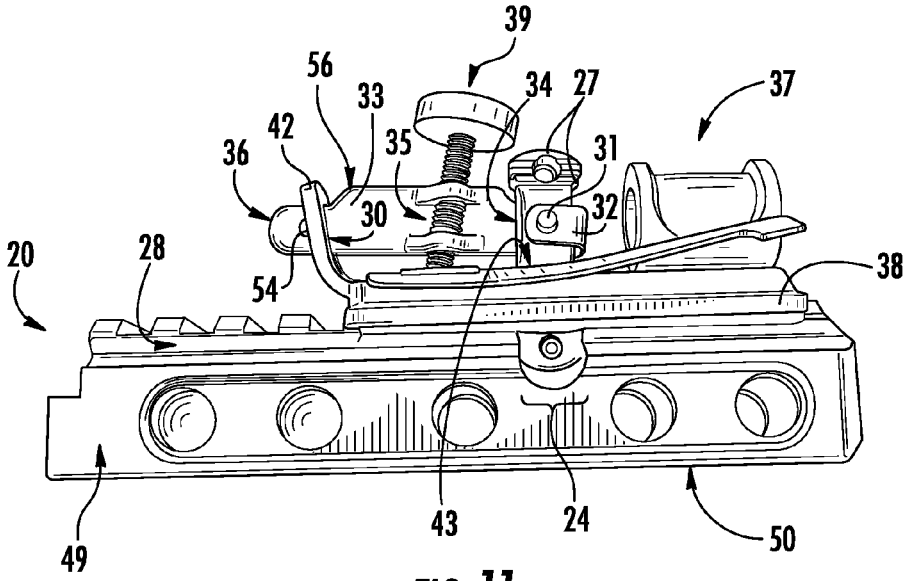
FIG. 11 is a side perspective view of the device shown in FIG. 4, illustrating an upper attachment configuration of a Harris Bipod coupled to said device.

As shown in FIG. 11, the upper attachment configuration 37 includes a base 38 with an opening 43 located in a substantially central portion thereof. The base 38 also includes a downwardly (in the orientation shown in FIG. 13) extending flange 42 at the forward end portion thereof. The upper attachment configuration 37 further includes a pair of attachment links 27 that extend upwardly (in the orientation shown in FIG. 13) through said opening 43 in the base 38. As illustrated in FIG. 8, the pair of links 27 include bottom pinch portions 47*a*, 47*b*; median portions 48*a*, 48*b*; and head portions 46*a*, 46*b* carrying opposing attachment pins 29*a*, 29*b* which are press fit therein.

Beneath the base 38 (in the orientation shown in FIG. 13), the upper attachment configuration 37 further includes a lever 33 (see FIGS. 10 and 11) that has a rearward end 34 interposed between the median portions 48*a*, 48*b* of the links 27; a mid portion 35 that is stamped and deformed to provide a threaded passageway therethrough to threadably receive a threaded element 39; and a forward end 36 that extends through a slot 30 in the downwardly extending flange 42 of the base 38 and is retained therein by a shoulder 56 on the lever 33 and a ring 44 (shown in FIG. 13) which is received through an aperture 54 in said forward end 36 of the lever 33.

The upper attachment configuration 37 also includes a U-shaped spring clip 32 (see FIGS. 8-11) that urges the median portion 48*a*, 48*b* of the links 27 against the rearward end 34 of the lever 33. A pivot pin 31 holds the spring clip 32 in place by extending transversely through the spring clip 32, through the median portion 48*a*, 48*b* of the links 27, and through the rearward end 34 of the lever 33. Finally, as shown in FIG. 11, the upper attachment configuration includes a threaded element 39 that is received by the mid portion 35 of the lever 33.

Figure 9:
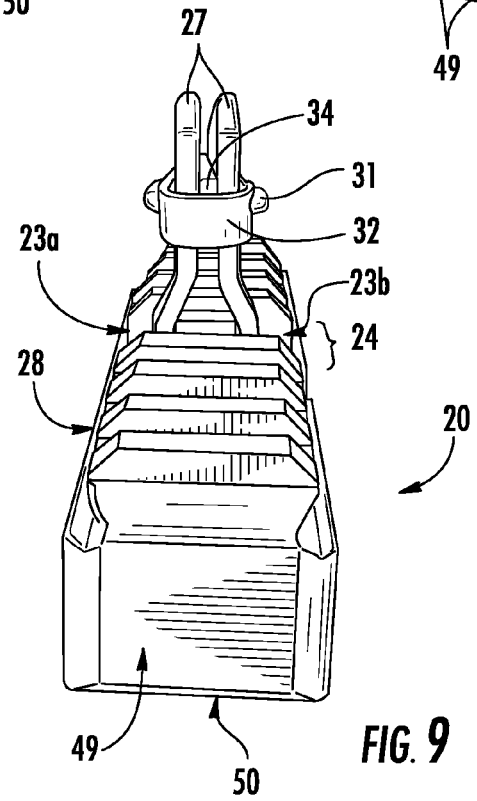
FIG. 9 is a front perspective view of the device shown in FIG. 4, illustrating a pair of attachment links coupled to the slot adapter of said device.

To secure the upper attachment configuration 37 to the presently disclosed device, the head portions 46*a*, 46*b* of the links 27 are moved upwardly (in the orientation shown in FIG. 13) through the opening 43 in the base 38. Then, as shown in FIG. 8, the bottom pinch portions 47*a*, 47*b* of the links 27 are pressed together to separate the head portions 46*a*, 46*b* of the links 27. Next, the head portions 46*a*, 46*b* can be positioned in the alignment slots 23*a*, 23*b* of the slot adapter 24. Once the head portions 46*a*, 46*b* are positioned in the alignment slots 23*a*, 23*b*, the attachment pins 29*a*, 29*b* are automatically aligned for insertion into the aperture 25 extending transversely through the engagement wall 51 that divides the alignment slots 23*a*, 23*b* of the slot adapter 24. As shown in FIG. 9, upon release of the pinch portions 47*a*, 47*b* of the attachment links 27, the attachment pins 29*a*, 29*b* are received by said aperture 25 extending transversely through the engagement wall 51 of the slot adapter 24.

Next, the threaded element 39 is rotated towards the base 38 to put pressure on the base 38, thereby forcing the base 38 upwardly (in the orientation shown in FIG. 13) against the accessory rail 20. At the same time, the threaded element 39 is connected to the lever 33 in such a way that when the threaded element 39 is rotated upwardly towards the base 38, the lever 33 is drawn slightly downwardly (in the orientation shown in FIG. 13). Further, the lever 33 is connected to the pair of links 27 in such a way that the links 27 are also drawn slightly downwardly (in the orientation shown in FIG. 13) along with the lever 33. The opposite forces created by the upper attachment configuration 37 against the accessory rail 20 with slot adapter 24 locks the upper attachment configuration 37 to the device disclosed herein. While these opposite forces tend to pull prior art sling studs loose over time, the device disclosed herein integrates the slot adapter 24 into the body of the accessory rail 20 to provide an exceptionally durable device that is not susceptible to breakage. This mechanism of attachment securely locks the upper attachment configuration 37 to the presently disclosed device.

When the accessory is to be removed from the firearm 40, the threaded element 39 is rotated away from the base 38, thereby unlocking the upper attachment configuration 37 from the disclosed device, to permit the base 38 to move downwardly (in the orientation shown in FIG. 13) over the median portions 48*a*, 48*b* of the links 27. Then, the pinch portions 47*a*, 47*b* of the links 27 are pressed together to separate the attachment pins 29*a*, 29*b* and to withdraw the pins 29*a*, 29*b* from the engagement wall aperture 25. Once the attachment pins 29*a*, 29*b* are withdrawn from the engagement wall aperture 25, the accessory can be lifted off the rail 20. In this manner, the presently disclosed device provides a quick and releasable attachment mechanism.

Though the present device and mechanism of use is discussed herein particularly with its application to bipod attachment for firearms, note that it is not intended to limit the spirit and scope of the present invention solely to use in conjunction with bipods and/or firearms. For example, the present device may be utilized to attach other accessories, such as slings, to firearms. Further, the present device can be mounted on primary devices other than firearms to releasably attach an accessory to a primary device, such as a camera.

The present invention clearly has a wide range of applications in circumstances wherein an auxiliary device is intended to be releasably attached to a primary device. Many other uses of the present invention will become obvious to one skilled in the art upon acquiring a thorough understanding of the present invention. Furthermore, while the present invention has been illustrated by the description of one or more embodiments thereof, and while the embodiments have been described in considerable detail, the foregoing is considered as illustrative only of the principles of the invention and it is not intended to restrict or in any way limit the scope of the appended claims to such detail. Once given the above disclosures, many other features, modifications, and variations will become apparent to the skilled artisan in view of the teachings set forth herein. Such other features, modifications, and variations are, therefore, considered to be a part of this invention, the scope of which is to be determined by the following claims.

The invention claimed is:

1. An accessory rail that is mountable on a primary device for releasably attaching an accessory directly to the accessory rail, comprising:

a rail body; and at least one slot adapter formed integrally within said body for receiving attachment means of the accessory, wherein said at least one slot adapter comprises a pair of alignment slots defining U-shaped channels sized to receive said attachment means of the accessory;

an engagement wall disposed between the pair of alignment slots; and an aperture extending transversely through the engagement wall.

2. The accessory rail with slot adapter according to claim 1, wherein saidprimary device is a firearm.

3. The accessory rail with slot adapter according to claim 1, wherein said primary device is a camera.

4. The accessory rail with slot adapter according to claim 1, wherein said accessory is a bipod.

5. The accessory rail with slot adapter according to claim 1, wherein said accessory is a Harris Bipod.

6. The accessory rail with slot adapter according to claim 1, wherein said accessory rail with slot adapter is configured for releasably attaching a bipod to a firearm.

7. The accessory rail with slot adapter according to claim 1, wherein said accessory rail with slot adapter is configured for releasably attaching a sling to a firearm.

8. The accessory rail with slot adapter according to claim 1, wherein said rail body includes at least one aperture receiving a fastener therethrough for mounting the rail body to the primary device.

9. The accessory rail with slot adapter according to claim 1, wherein said rail body further comprises:

a mounting surface;

a bottom surface opposite of said mounting surface; and lateral surfaces connecting said mounting surface to said bottom surface.

10. The accessory rail with slot adapter according to claim 9, wherein said at least one slot adapter is formed in said mounting surface.

11. An accessory rail that is mountable on a primary device for releasably attaching an accessory directly to the accessory rail, comprising:

a rail body, wherein said rail body is a Picatinny rail; and at least one slot adapter formed integrally within said body for receiving attachment means of the accessory, wherein said at least one slot adapter comprises a pair of alignment slots;

an engagement wall disposed between the pair of alignment slots; and an aperture extending transversely through the engagement wall.

12. An accessory rail that is mountable on a primary device for releasably attaching an accessory directly to the accessory rail, comprising:

a rail body that further comprises a mounting surface including a plurality of mounting projections extending perpendicularly along a longitudinal axis of the rail body, wherein said mounting projections are separated by a plurality of transverse grooves evenly spaced along the longitudinal axis of the rail body; and at least one slot adapter formed integrally within said rail body for receiving attachment means of the accessory;

a bottom surface opposite of said mounting surface; and lateral surfaces connecting said mounting surface to said bottom surface;

wherein said at least one slot adapter comprises a pair of alignment slots;

an engagement wall disposed between the pair of alignment slots; and an aperture extending transversely through the engagement wall.

13. The accessory rail with slot adapter according to claim 9, wherein said lateral surfaces include at least one cutout therein.

14. A method of releasably attaching a bipod to a firearm, wherein the bipod includes an upper attachment configuration comprising a base, a pair of attachment links carrying attachment pins, a lever connecting the attachment links to the base, and a threaded element being threadably received by the lever, said method comprising:

mounting an accessory rail with slot adapter on the firearm, wherein the slot adapter is formed integrally within said rail and the slot adapter includes a pair of alignment slots defining U-shaped channels sized to receive said attachment links, an engagement wall disposed between the pair of alignment slots, and an aperture extending transversely through the engagement wall; and connecting the upper attachment configuration of the bipod to the accessory rail with slot adapter.

15. The method according to claim 14, wherein the bipod is a Harris Bipod.

16. The method according to claim 14, wherein connecting the upper attachment configuration to the accessory rail with slot adapter comprises the following steps in the sequence set forth:

moving head portions of said attachment links through an opening in the base;

pressing pinch portions of said links together, thereby separating the head portions carrying the attachment pins;

positioning the head portions of said links in the alignment slots of said slot adapter; and releasing the pinch portions of the links, thereby allowing the attachment pins to insert into the aperture extending transversely through the engagement wall and thereby connecting the upper attachment configuration to the slot adapter.

17. The method according to claim 16, wherein connecting the upper attachment configuration to the accessory rail with slot adapter further comprises a subsequent step of rotating said threaded element towards the base, thereby locking the upper attachment configuration to the accessory rail with slot adapter.

18. The method according to claim 16, wherein the upper attachment configuration of the bipod is detached from the accessory rail with slot adapter, the method further comprising the following steps in the sequence set forth:

pressing the pinch portions of the attachment links together, thereby withdrawing the attachment pins from the aperture extending transversely through the engagement wall; and lifting the upper attachment configuration off of said rail, thereby detaching said upper attachment configuration from said rail with slot adapter.

19. The method according to claim 17, wherein said upper attachment configuration of the bipod is detached from the accessory rail with slot adapter, the method further comprising the following steps in the sequence set forth:

rotating said threaded element away from the base, thereby unlocking the upper attachment configuration from the accessory rail with slot adapter;

pressing the pinch portions of the attachment links together, thereby withdrawing the attachment pins from the aperture extending transversely through the engagement wall; and lifting the upper attachment configuration off of said rail, thereby detaching said upper attachment configuration from said rail with slot adapter.

* * * * *